US005935773A

United States Patent [19]

Hagemann et al.

[11] Patent Number: 5,935,773

[45] Date of Patent: Aug. 10, 1999

[54] COLOUR PHOTOGRAPHIC SILVER HALIDE MATERIAL

[75] Inventors: Jörg Hagemann, Hahnenweg 1; Günter Helling, In der Hildscheild 16, both of Germany

[73] Assignee: Agfa-Gevaert AG, Germany

[21] Appl. No.: 08/639,970

[22] Filed: Apr. 29, 1996

[30] Foreign Application Priority Data

May 10, 1995 [DE] Germany ..... 195 17 073.3

[51] Int. Cl.[6] ..... G03C 1/46

[52] U.S. Cl. ..... 430/505; 430/551; 430/552; 430/553; 430/556; 430/557; 430/607; 430/613; 430/631; 430/489; 430/415; 430/448

[58] Field of Search ..... 430/505, 551, 430/552, 553, 556, 557, 607, 613, 631, 489, 415, 448

[56] References Cited

U.S. PATENT DOCUMENTS

| | | | |
|---|---|---|---|
| 4,839,269 | 6/1989 | Okazaki et al. | 430/570 |
| 5,352,563 | 10/1994 | Kawasaki et al. | 430/613 |
| 5,376,509 | 12/1994 | Yoshimoto et al. | 430/489 |

*Primary Examiner*—Geraldine Letscher
*Attorney, Agent, or Firm*—Connolly & Hutz

[57] ABSTRACT

A colour photographic silver halide material with a support, at last one silver halide emulsion layer containing at least one yellow coupler and at least one silver halide emulsion layer containing a cyan coupler applied thereon, in which material the silver halide emulsion layer, of which there is at least one, containing at least one yellow coupler and/or the silver halide emulsion layer, of which there is at least one, containing at least one cyan coupler contains a compound of the formula (I)

(I)

in which $R_1$, $R_2$, $R_3$ mean alkyl, alkenyl or acyl and n means 6, 7 or 8, is distinguished by improved stability of the image dyes produced by processing.

11 Claims, No Drawings

COLOUR PHOTOGRAPHIC SILVER HALIDE MATERIAL

This invention relates to a colour photographic silver halide material, the image dyes of which, produced by development, are distinguished by improved stability, in particular dark storage stability.

The light and dark storage stability of the yellow dyes of a colour photographic silver halide material are not sufficient to satisfy all requirements. The same applies to the dark storage stability of cyan dyes based on phenolic cyan couplers and the light stability of cyan dyes based on pyrrolotriazole cyan couplers.

The object of the invention was to remedy these weaknesses.

It has now been found that this object may be achieved if a compound of the formula (I) is added to a silver halide emulsion layer containing a yellow coupler and/or a silver halide emulsion layer containing a cyan coupler:

(I)

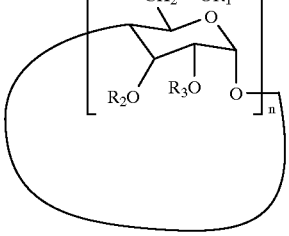

in which $R_1$, $R_2$, $R_3$ mean alkyl, alkenyl or acyl and n means 6, 7 or 8.

The acyl residue may be derived from an aliphatic or aromatic carboxylic, carbonic, carbamic, sulphonic, aminosulphonic, phosphonic, phosphoric or phosphorous acid.

Alkyl and alkenyl may be linear, branched or cyclic and substituted or unsubstituted, wherein hydroxy, alkoxy, aryloxy, halogen, carboxy, sulpho and aryl may be considered as substituents. Alkyl and alkenyl have in particular 1 to 18 C atoms.

The compounds of the formula (I) are in particular added to a layer in a quantity of 10 to 1000 mg/m$^2$, preferably in a quantity of 20 to 600 mg/m$^2$, wherein water-soluble compounds are added to the aqueous phase and ethyl acetate-soluble compounds to the organic phase of a casting solution.

The substituents $R_1$, $R_2$, $R_3$ may be identical or different. If they are different, it is frequently impossible precisely to determine their position within the molecule of the formula (I). The following list thus merely states the ratios in which they occur in the molecule.

Suitable compounds are:

| Compound | n | $R_1$, $R_2$, $R_3$ |
|---|---|---|
| I-1 | 6 | H |
| I-2 | 7 | H |
| I-3 | 8 | H |
| I-4 | 6 | H/$CH_3$ (1:1) |
| I-5 | 7 | H/$CH_3$ (2:3) |
| I-6 | 8 | H/$CH_3$ (1:2) |
| I-7 | 6 | $C_4H_9$-s |

-continued

| Compound | n | $R_1$, $R_2$, $R_3$ |
|---|---|---|
| I-8 | 7 | $C_3H_7$ |
| I-9 | 8 | $C_2H_5$ |
| I-10 | 6 | H, $C_{12}H_{25}$ (2:1) |
| I-11 | 7 | H, $C_8H_{17}$-i (1:1) |
| I-12 | 8 | H, $C_{18}H_{35}$ (4:1) |
| I-13 | 6 | —CO—$CH_3$ |
| I-14 | 7 | —CO—$C_2H_5$ |
| I-15 | 8 | H, —CO—$CH_3$ (1:2) |
| I-16 | 6 | —CO—$C_3H_7$ |
| I-17 | 7 | H, —CO—$C_{13}H_{27}$ (2;1) |
| I-18 | 8 | H, —CO—CH($C_2H_5$)—$C_4H_9$ (3:2) |
| I-19 | 6 | —CO—O—$C_2H_5$ |
| I-20 | 7 | 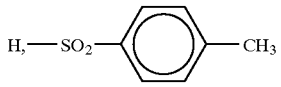 |
| I-21 | 8 | H, —P(=O)(O—$CH_2$—CH($C_2H_5$)—$(C_4H_9)_2$ (4:1) |
| I-22 | 6 | H, —CO—NH—$C_4H_9$-t (1:1) |
| I-23 | 7 | —CO—$CH_3$ |
| I-24 | 8 | —CO—$CH_3$ |
| I-25 | 6 | H, —$CH_2CH_2$—O—$CH_2CH_2$—O—$CH_3$ (2;1) |
| I-26 | 7 | H, —$CH_2CH_2$—CO—NH—$C_4H_9$-t (2:1) |
| I-27 | 8 | H, —$CH_2$—$C_5H_6$ (1:1) |

One layer containing a yellow coupler preferably additionally contains at least one compound of the formulae (II) and (III) or one layer containing a cyan coupler preferably additionally contains at least one compound of the formula (IV) and (V):

(II)

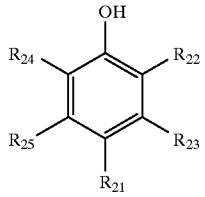

(III)

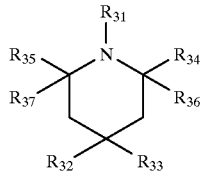

(IV)

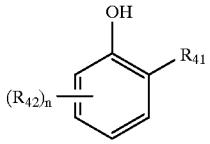

(V)

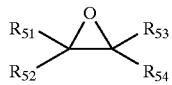

in which $R_{21}$ means alkyl, alkenyl, acyl, alkoxy, aryloxy, alkylthio, arylthio or -$NR_{26}R_{27}$, $R_{22}$, $R_{23}$, $R_{24}$, $R_{25}$ mean H or $R_{21}$, $R_{26}$ means alkyl, aryl or acyl and $R_{27}$ means H, alkyl or aryl;

$R_{31}$ means H, alkyl or acyl, $R_{32}$, $R_{33}$ mean H, alkyl, aryl, acyl, acyloxy, acylamino or alkoxy, $R_{34}$, $R_{35}$ mean alkyl or aryl and $R_{36}$, $R_{37}$ mean H, alkyl or aryl;

$R_{41}$ means triazin-2-yl or benzotriazol-2-yl, $R_{42}$ means alkyl, alkoxy, acyl, acyloxy or acylamino and n means 0, 1, 2, 3 or 4;

$R_{51}$ means alkyl, aryl, acyl or alkenyl and $R_{52}$, $R_{53}$, $R_{54}$ mean H or $R_{51}$, wherein the triazin-2-yl and benzotriazol-2-yl residues $R_{41}$ may also be further substituted, as may all alkyl, alkenyl and acyl residues.

The acyl residues are in particular derived from the same acids as the acyl residues $R_1$, $R_2$, $R_3$. The alkyl and alkenyl residues have in particular 1 to 18 C atoms. Aryl residues may be substituted by alkyl, hydroxy, acyl, alkoxy, acyloxy or acylamino. Phenyl residues are preferred.

Examples of compounds of the formula (II) to (V) are:

II-1

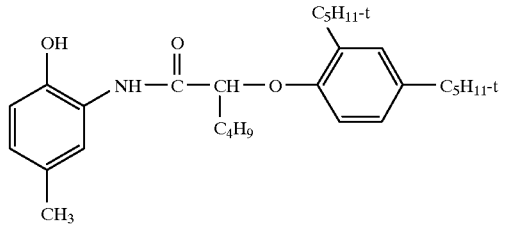

II-2

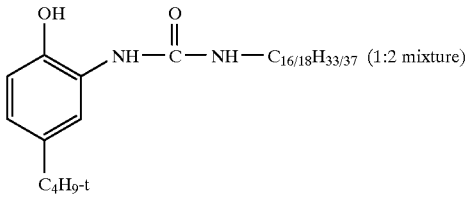

II-3

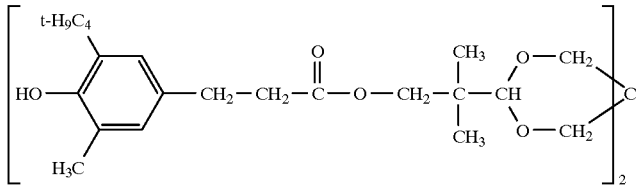

II-4

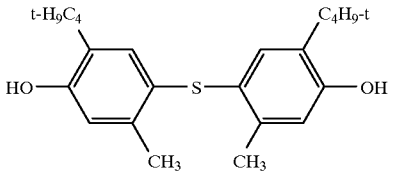

II-5

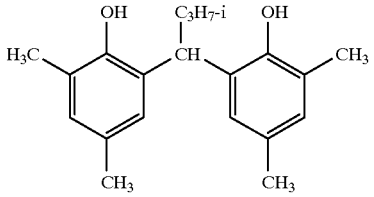

-continued
II-6
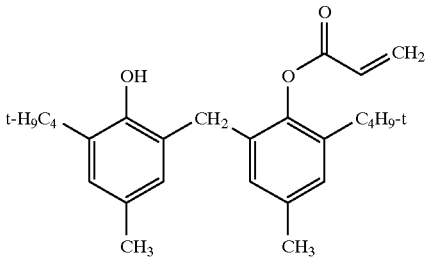
II-7
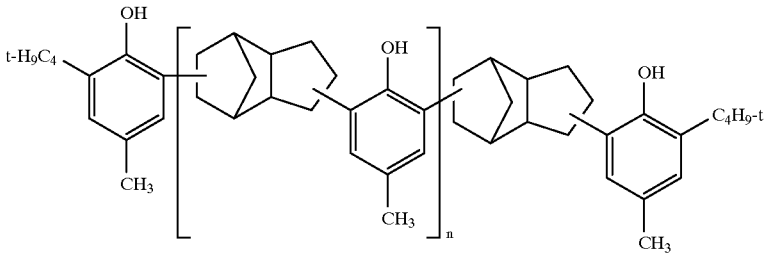
N ≈ 1.5
II-8
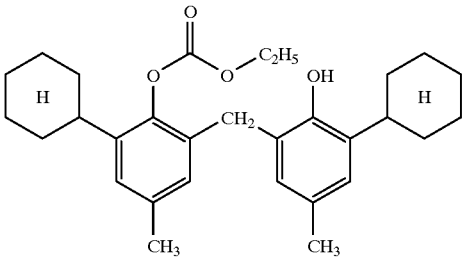
II-9
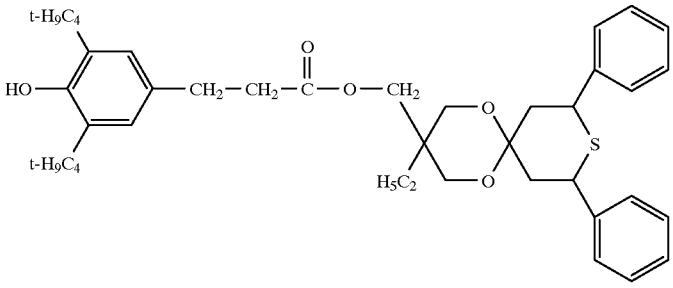
II-10
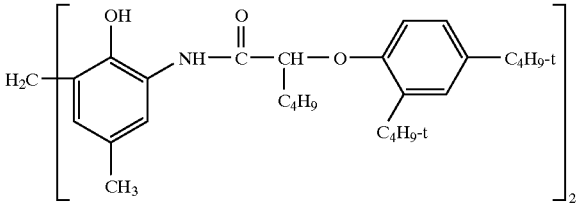

-continued
III-1
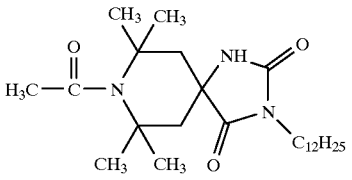
III-2
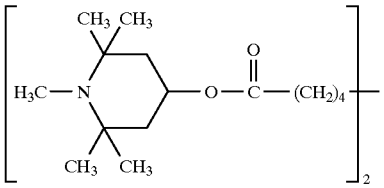
III-3
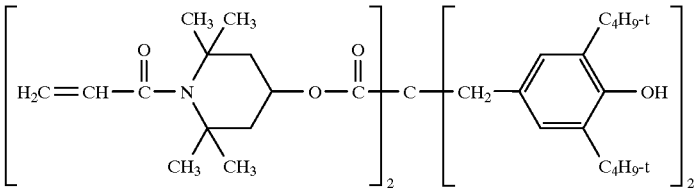
III-4
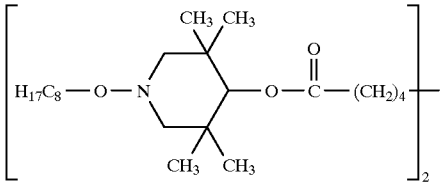
III-5
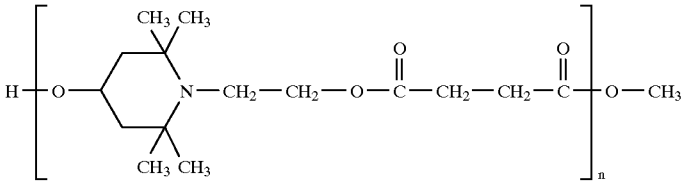
IV-1
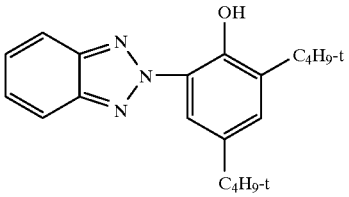

-continued
IV-2
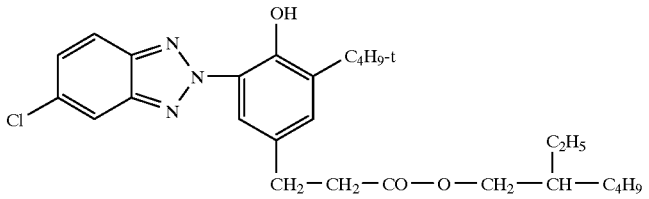
IV-3
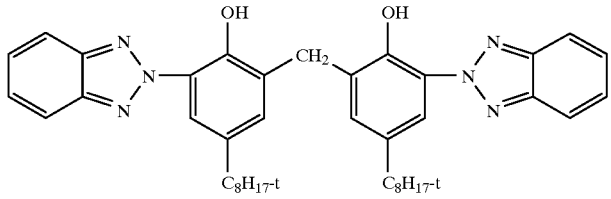
IV-4
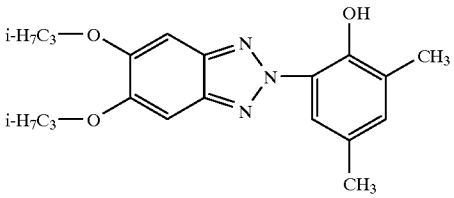
IV-5
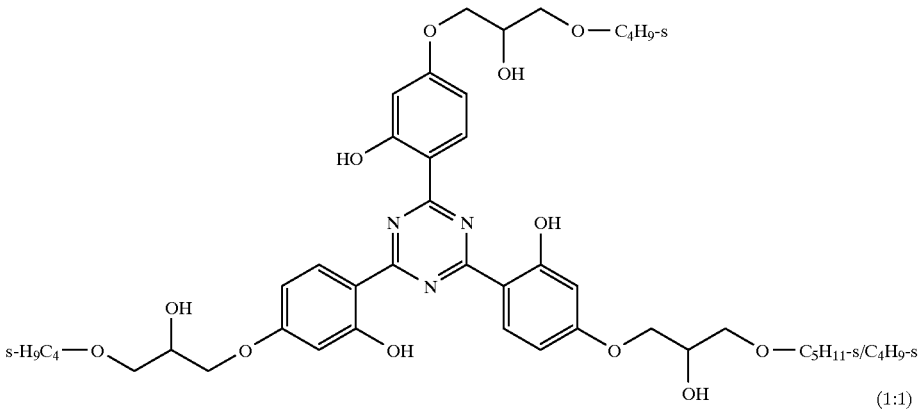
(1:1)

-continued
IV-6
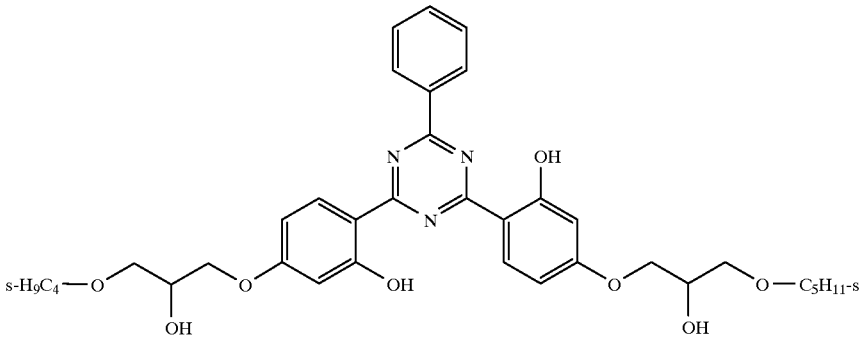
IV-7
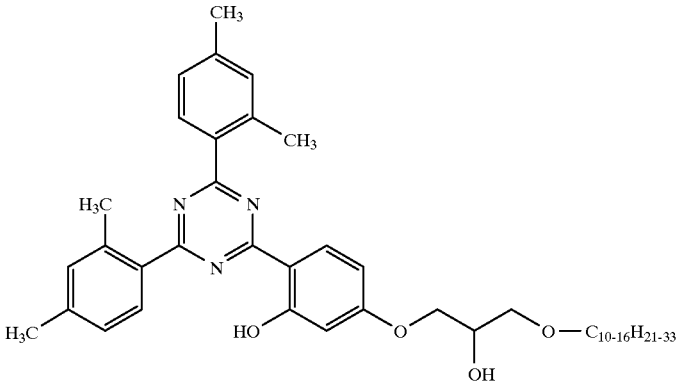
V-1
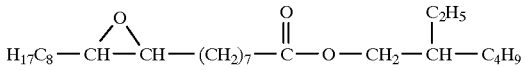
V-2
epoxidised soya oil, oxirane content: 6.5 wt.%
V-3
epoxidised linseed oil, oxirane content: 8.9 wt.%
V-4
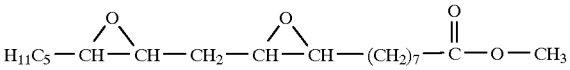

-continued

V-5

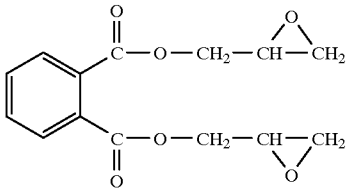

V-6

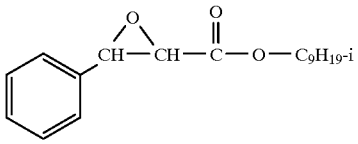

The compounds of the formulae II to V are added to the particular layer preferably in a total quantity of 30 to 300 mg/m$^2$.

Examples of colour photographic materials are colour negative films, colour reversal films, colour positive films, colour photographic paper, colour reversal photographic paper, colour-sensitive materials for the dye diffusion transfer process or the silver dye bleaching process.

The photographic materials consist of a support on which at least one photo-sensitive silver halide emulsion layer is accommodated. Thin films and sheets are in particular suitable as supports. A review of support materials and the auxiliary layers applied to the front and reverse sides of which is given in *Research Disclosure* 37254, part 1 (1995), page 285.

The colour photographic materials conventionally contain at least one red-sensitive, one green-sensitive and one blue-sensitive silver halide emulsion layer, optionally together with interlayers and protective layers.

Depending upon the type of the photographic material, these layers may be differently arranged. This is demonstrated for the most important products:

Colour photographic films such as colour negative films and colour reversal films have on the support, in the stated sequence, 2 or 3 red-sensitive, cyan-coupling silver halide emulsion layers, 2 or 3 green-sensitive, magenta-coupling silver halide emulsion layers and 2 or 3 cyan-sensitive, yellow-coupling silver halide emulsion layers. The layers of identical spectral sensitivity differ with regard to their photographic sensitivity, wherein the less sensitive partial layers are generally arranged closer to the support than the more highly sensitive partial layers.

A yellow filter layer is conventionally located between the green-sensitive and blue-sensitive layers to prevent blue light from reaching the underlying layers.

Colour photographic paper, which is usually substantially less photosensitive than a colour photographic film, conventionally has on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, all high sensitivity layers may be grouped together in one package of layers and all low sensitivity layers may be grouped together in another package of layers in order to increase sensitivity (DE-A-25 30 645).

Possible options for different layer arrangements and the effects thereof on photographic properties are described in *J. Int. Rec. Mats.,* 1994, volume 22, pages 183–193.

The substantial constituents of the photographic emulsion layers are binder, silver halide grains and colour couplers.

Details of suitable binders may be found in *Research Disclosure* 37254, part 2 (1995), page 286.

Details of suitable silver halide emulsions, the production, ripening, stabilisation and spectral sensitisation thereof, including suitable spectral sensitisers, may be found in *Research Disclosure* 37254, part 3 (1995), page 286 and in *Research Disclosure* 37038, part XV (1995), page 89.

Photographic materials with camera sensitivity conventionally contain silver bromide-iodide emulsions, which may optionally also contain small proportions of silver chloride, Photographic copying materials contain either silver chloride-bromide emulsions with up to 80 mol. % of AgBr or silver chloride-bromide emulsions with above 95 mol. % of AgCl.

Details relating to colour couplers may be found in *Research Disclosure* 37254, part 4 (1995), page 288 and in *Research Disclosure* 37038, part II (1995), page 80. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in *Research Disclosure* 37254, part 5 (1995), page 290 and in *Research Disclosure* 37038, part XIV (1995), page 86.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 $\mu$m in diameter) in the layers.

Suitable high-boiling organic solvents, methods for the introduction thereof into the layers of a photographic material and further methods for introducing chemical compounds into photographic layers may be found in *Research Disclosure* 37254, part 6 (1995), page 292.

The non photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in *Research Disclosure* 37254, part 7 (1995), page 292 and in *Research Disclosure* 37038, part III (1995), page 84.

The photographic material may also contain UV light absorbing compounds, optical whiteners, spacers, filter dyes, formalin scavengers, light stabilisers, anti-oxidants, $D_{min}$ dyes, additives to improve stabilisation of dyes, couplers and whites and to reduce colour fogging, plasticisers (latices), biocides and others.

Suitable compounds may be found in *Research Disclosure* 37254, part 8 (1995), page 292 and in *Research Disclosure* 37038, parts IV, V, VI, VII, X, XI and XIII (1995), pages 84 et seq..

The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294 and in *Research Disclosure* 37038, part XII (1995), page 86.

Once exposed with an image, colour photographic materials are processed using different processes depending upon their nature. Details relating to processing methods and the necessary chemicals are disclosed in *Research Disclosure* 37254, part 10 (1995), page 294 and in *Research Disclosure* 37038, parts XVI to XMII (1995), pages 95 et seq. together with example materials.

Example 1

A colour photographic recording material suitable for rapid processing was produced by applying the following layers in the stated sequence onto a film base made from paper coated on both sides with polyethylene. The stated quantities relate in each case to 1 $m^2$. The corresponding quantities of $AgNO_3$ are stated for the applied quantity of silver halide.

Layer Structure Sample 1

Layer 1: (Substrate layer)

0.2 g of gelatine

Layer 2: (Blue-sensitive layer)

Blue-sensitive silver halide emulsion (99.5 mol. % chloride, 0.5 mol. % bromide, average grain diameter 0.8 μm) prepared from 0.53 g of $AgNO_3$ with 1.11 g of gelatine 0.60 g of yellow coupler Y-1

0.15 g of white coupler W-1

0.06 g of oil former OF-1

0.24 g of tricresyl phosphate (TCP)

Layer 3: (Protective layer)

1.1 g of gelatine 0.04 g of 2,5-di-tert.-octylhydroquinone 0.04 g of compound SC-1

0.04 g of TCP

Layer 4: (Green-sensitive layer)

Green-sensitised silver halide emulsion (99.5 mol. % chloride, 0.5 mol. % bromide, average grain diameter 0.6 μm) prepared from 0.25 g of $AgNO_3$ with 0.95 g of gelatine 0.20 g of magenta coupler M-1

0.20 g of dye stabiliser ST-1

0.10 g of dye stabiliser ST-2

0.18 g of oil former OF-2

0.12 g of oil former OF-3

Layer 5: (UV protective layer)

0.75 g of gelatine 0.2 g of UV absorber UV-1

0.1 g of UV absorber UV-2

0.025 g of 2,5-di-tert.-octylhydroquinone 0.02 g of compound SC-1

0.1 g of oil former OF-4

0.04 g of TCP

Layer 6: (Red-sensitive layer)

Red-sensitised silver halide emulsion (99.5 mol. % chloride, 0.5 mol. % bromide, average grain diameter 0.5 μlm) prepared from 0.30 g of $AgNO_3$ with 0.75 g of gelatine 0.36 g of cyan coupler C-1

0.36 g of TCP

Layer 7: (UV protective layer)

0.85 g of gelatine 0.36 g of UV absorber UV-1

0.18 g of UV absorber UV-2

0.18 g of oil former OF-4

Layer 8: (Protective layer)

0.9 g of gelatine 0.3 g of hardener H-1

The following compounds were used in the example 1 samples:

Y-1

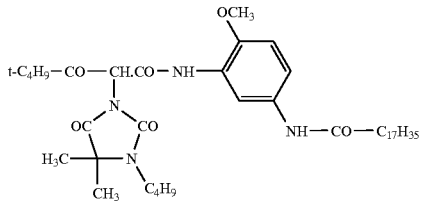

M-1

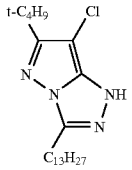

-continued

C-1

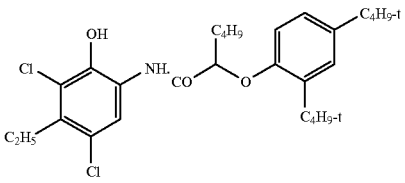

W-1

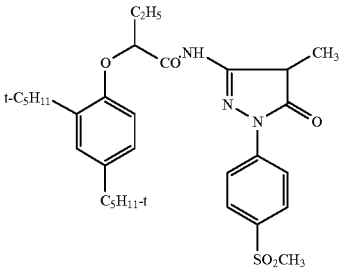

ST-1

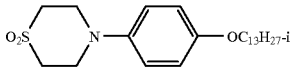

ST-2

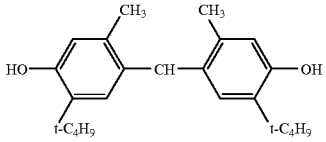

OF-1

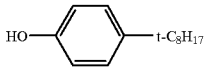

OF-2

$C_4H_9O—CO—(CH_2)_4—CO—OC_4H_9$

OF-3

$C_{14}H_{29}$-OH/$C_{12}H_{25}$-OH (1:3)

OF-4 i-$H_{19}C_9OCO—(CH_2)_4—COOC_9H_{19}$-i

SC-1

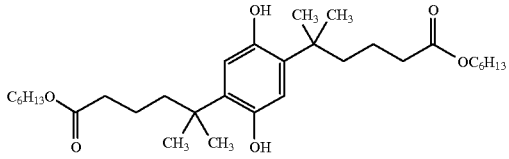

UV-1

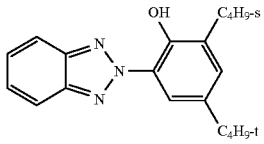

UV-2

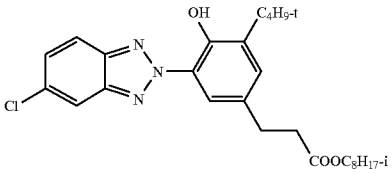

H-1

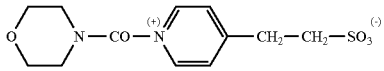

Samples 2 to 14

Samples 2 to 14 were produced in the same manner as sample 1 with the difference that a compound of the formula (I) and optionally also a compound of the formulae (II) or (III) were additionally added to layer 2 (see table 1).

The samples are then exposed behind a graduated grey wedge through a U449 filter and then processed as follows:

a) Colour developer—45 seconds—35° C.

Tetraethylene glycol 20.0 g,

N,N-Diethylhydroxylamine 4.0 g

N-Ethyl-N-(2-m ethanesul phonamidoethyl)-4-amino-3-methylbenzene sesquisulphate 5.0 g Potassium sulphite 0.2 g Potassium carbonate 30.0 g Polymaleic anhydride 2.5 g Hydroxyethanediphosphonic acid 0.2 g Optical whitener (4,4'-diaminostilbene-sulphonic acid derivative) 2.0 g Potassium bromide 0.02 g make up to 1000 ml with water; adjust pH value to pH 10.2 with KOH or $H_2SO_4$.

b) Bleach/fixing2 bath—45 seconds—35° C.

Ammonium thiosulphate 75.0 g

Sodium hydrogen sulphite 13.5 g

Ethylenediaminetetraacetic acid (iron-ammonium salt) 45.0 g make up to 1000 ml with water; adjust pH value to pH 6.0 with ammonia (25%) or acetic acid.

c) Rinsing—2 minutes—33° C.

d) Drying

The percentage cyan secondary density (bg-ND) at a yellow density of 1.0 (D(gb)) and fog were measured on the samples. The samples were then stored in the dark for 84 days at 80° C. and 50% relative humidity and the percentage reduction in maximum density ($\Delta D_{max}$) determined. The samples were also exposed to 20 –$10^6$ luxh of light from a daylight-standardised xenon lamp and the percentage reduction in density at an initial density of 1.0 ($\Delta D_{1.0}$) was determined. All the values are shown in table 1.

E: according to the invention;

V: comparison.

Quantities in g/m$^2$ are stated between brackets.

As is shown by table 1, the compounds according to the invention reduce the cyan secondary density and fog and improve dark storage stability. In conjunction with the compounds of the formulae (II) and (III), light stability is also improved.

TABLE 1

| Sample | Addition | bg-ND | $D_{min}$ | $\Delta D_{max}$ | $\Delta D_{1.0}$ |
|---|---|---|---|---|---|
| 1 (V) | none | 2.4 | 141 | 28 | 47 |
| 2 (E) | I-1 (0.24) | 2.1 | 114 | 19 | 44 |
| 3 (E) | I-16 (0.24) | 2.2 | 102 | 18 | 46 |
| 4 (E) | I-3 (0.24) | 2.1 | 101 | 20 | 45 |
| 5 (E) | I-5 (0.24) | 2.1 | 107 | 20 | 43 |
| 6 (E) | I-23 (0.24) | 2.1 | 108 | 18 | 44 |
| 7 (V) | II-1 (0.12) | 2.5 | 143 | 27 | 22 |
| 8 (E) | II-1 (0.12), I-2 (0.18) | 2.1 | 113 | 18 | 20 |
| 9 (E) | II-1 (0.12), I-13 (0.18) | 2.2 | 109 | 19 | 22 |
| 10 (V) | II-7 (0.12) | 2.6 | 147 | 26 | 27 |
| 11 (E) | II-7 (0.12), I-1 (0.18) | 2.2 | 111 | 17 | 28 |
| 12 (E) | II-7 (0.12), I-5 (0.18) | 2.2 | 106 | 18 | 27 |
| 13 (V) | III-1 (0.18) | 2.4 | 144 | 28 | 29 |
| 14 (E) | III-1 (0.18), I-17 (0.18) | 2.1 | 115 | 21 | 30 |

EXAMPLE 2

Samples 15 to 24 were produced in the same manner as sample 1 with the difference that a compound of the formula (I) and optionally also a compound of the formulae (IV) or (V) were additionally added to layer 6.

The samples were then exposed behind a graduated grey wedge through a L662 filter and then processed as described in example 1.

The samples were then stored in the dark for 60 days at 80° C. and 50% relative humidity and the percentage reduction in maximum density ($\Delta D_{max}$) determined.

The results may be seen in table 2:

TABLE 2

| Sample | Addition | $\Delta D_{max}$ |
|---|---|---|
| 1 (V) | none | 32 |
| 15 (E) | I-1 (0.18) | 24 |
| 16 (E) | I-5 (0.18) | 25 |
| 17 (E) | I-13 (0.18) | 26 |
| 18 (E) | I-18 (0.18) | 27 |
| 19 (E) | IV-1 (0.12), I-5 (0.12) | 20 |
| 20 (E) | IV-2 (0.12), I-2 (0.12) | 19 |
| 21 (E) | IV-5 (0.12), I-1 (0.12) | 18 |
| 22 (E) | IV-6 (0.12), I-16 (0.12) | 21 |
| 23 (E) | V-3 (0.12), I-6 (0.12) | 19 |
| 24 (E) | V-4 (0.12), I-23 (0.12) | 17 |

As is shown by table 2, the compounds according to the invention improve the dark storage stability of the cyan dye; if, as preferred, compounds of the formula (IV) or (V) are used in addition to the compounds according to the invention, dark storage stability is still further improved.

We claim:

1. A color photographic silver halide material comprising (a) a support, (b) at least one silver halide emulsion layer containing at least one yellow coupler or a cyan coupler (c) a compound of the formula (I) in said silver halide emulsion layer (I)

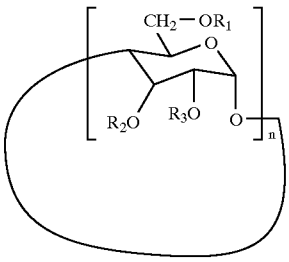

in which $R_1$, $R_2$ and $R_3$ independently of one another are hydrogen, alkyl, alkenyl or acyl and n means 6, 7 or 8.

2. The color photographic silver halide material according to claim 1, wherein the compounds of the formula I are added to a layer in a quantity of 10 to 1000 mg/m$^2$.

3. The color photographic silver halide material according to claim 1, wherein at least one layer containing a yellow coupler additionally contains at least one compound of the formula (II) or (III) or at least one layer containing a cyan coupler additionally contains at least one compound of the formula (IV) or (V):

(II)

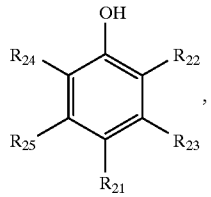

(III)

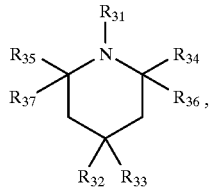

(IV)

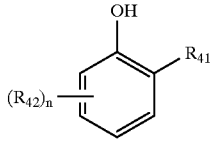

or (V)

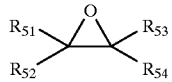

in which $R_{21}$ means alkyl, alkenyl, acyl, alkoxy, aryloxy, alkylthio, arylthio or $-NR_{26}R_{27}$, $R_{22}$, $R_{23}$, $R_{24}$ and $R_{25}$ independently of one another mean H or $R_{21}$, $R_{26}$ means alkyl, aryl or acyl and $R_{27}$ means H, alkyl or acyl;

$R_{31}$ means H, alkyl or acyl, $R_{32}$ and $R_{33}$ independently of one another mean H, alkyl, aryl, acyl, acyloxy, acylamino or alkoxy, $R_{34}$ and $R_{35}$ independently of one another mean alkyl or aryl and $R_{36}$ and $R_{37}$ independently of one another H, alkyl or aryl;

$R_{41}$ means triazin-2-yl or benzotriazxol-2-yl, $R_{42}$ means alkyl, alkoxy, acyl, acyloxy or acylamino and n means 0, 1, 2, 3 or 4;

$R_5$, means alkyl, aryl, acyl or alkenyl and $R_{52}R_{53}$ and $R_{54}$ independently of one another mean H or $R_{51}$.

4. The color photographic silver halide material according to claim 3, wherein the compounds of the formula II to V are added to the layer in a total quantity of 30 to 300 mg/M$^2$.

5. The color photographic silver halide material according to claim 1, wherein the compounds of the formula I are added to a layer in a quantity of 20 to 600 mg/m$^2$.

6. A process to improve stability of a color photographic silver halide material which comprises adding a compound of the formula (I) in (a) a silver halide emulsion layer which contains at least one yellow coupler or (b) a silver halide emulsion layer which contains a cyan coupler,

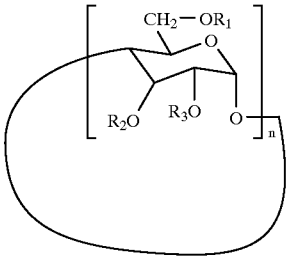

(I)

in which $R_1$, $R_2$ and $R_3$ independently of one another are hydrogen, alkyl, alkenyl or acyl and n means 6, 7 or 8.

7. The process according to claim 6, wherein the compound of the formula I is added to the silver halide emulsion layer in a quantity of 10 to 1,000 mg/m$^2$.

8. The process as claimed in claim 7, wherein at least one layer containing a yellow coupler additionally contains at least one compound of the formula (II) or (III) or at least one layer containing a cyan coupler additionally contains at least one compound of the formula (IV) or (V):

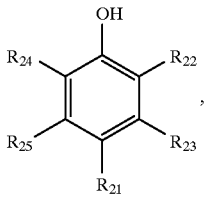

(II)

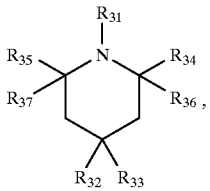

(III)

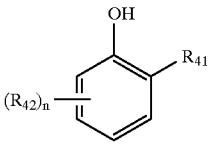

(IV)

or

-continued

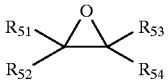

(V)

in which $R_{21}$ means alkyl, alkenyl, acyl, alkoxy, aryloxy, alkylthio, arylthio or $-NR_{26}R_{27}$, $R_{22}$, $R_23$, $R_{24}$ and $R_{25}$ independently of one another mean H or $R_{21}$, $R_{26}$ means alkyl, aryl or acyl and $R_{27}$ means H, alkyl or acyl;

$R_{31}$ means H, alkyl or acyl, $R_{32}$ and $R_{33}$ independently of one another mean H, alkyl, aryl, acyl, acyloxy, acylamino or alkoxy, $R_{34}$ and $R_{35}$ independently of one another mean alkyl or aryl and $R_{36}$ and $R_{37}$ independently of one another H, alkyl or aryl;

$R_{41}$ means triazin-2-yl or benzotriazxol-2-yl, $R_{42}$ means alkyl, alkoxy, acyl, acyloxy or acylamino and n means 0, 1, 2, 3 or 4;

$R_{51}$ means alkyl, aryl, acyl or alkenyl and $R_{52}$, $R_{53}$ and $R_{54}$ independently of one another mean H or $R_5$,.

9. The process according to claim 8, wherein the compounds of the formula II to V are added to the silver halide emulsion layer in a total quantity of 30 to 300 mg/m$^2$.

10. The process according to claim 9, wherein the compound of the formula I is added to the silver halide emulsion layer in a quantity of 20 to 600 mg/m$^2$.

11. The process according to claim 10, wherein the color photographic silver halide material contains a support, at least one silver halide emulsion layer containing at least one yellow coupler and at least one silver halide emulsion layer containing a cyan coupler.

* * * * *